United States Patent [19]

Komatsu

[11] Patent Number: 4,633,048

[45] Date of Patent: Dec. 30, 1986

[54] JACK WITH A SWITCH

[75] Inventor: Yasuhiro Komatsu, Osaka, Japan

[73] Assignee: Hosiden Electronics Co., Ltd., Osaka, Japan

[21] Appl. No.: 789,600

[22] Filed: Oct. 21, 1985

[30] Foreign Application Priority Data

Dec. 30, 1984 [JP] Japan ..... 59-201440[U]

[51] Int. Cl.[4] ..... H01R 33/96

[52] U.S. Cl. ..... 200/51.1; 200/51.12; 339/258 P

[58] Field of Search ..... 200/51.12, 51.09, 51.1, 200/51.11; 339/252 S, 256 R, 258 P, 256 S

[56] References Cited

U.S. PATENT DOCUMENTS

| | | | |
|---|---|---|---|
| 2,089,165 | 8/1937 | Oliver | 200/51.1 |
| 2,942,074 | 6/1960 | Gloviak et al. | 200/51.1 |
| 4,150,863 | 4/1979 | Krafthefer et al. | 339/258 P |

*Primary Examiner*—James E. Bryant, III
*Assistant Examiner*—R. S. Luebke
*Attorney, Agent, or Firm*—Pollock, Vande Sande and Priddy

[57] ABSTRACT

A jack having a structure in which a movable contact is driven and separated from a fixed contact when a plug is inserted thereinto and the movable contact is brought into contact electrically with the plug. A free-end part of the movable contact is formed as the plug receptor which is in contact with the inserted plug and is driven by the plug, and both marginal sides of the plug receptor are extended and bent towards the fixed contact to form a pair of holding parts which are provided with flaps extending rearwardly to approach each other. These flaps resiliently hold therebetween the inserted plug. Contact parts are defined at the marginal portions of the holding parts on the side of the fixed contact so as to be in resilient contact therewith.

8 Claims, 7 Drawing Figures

JACK WITH A SWITCH

FIELD OF THE INVENTION

The present invention relates to a jack with a switch wherein, when a plug is inserted, a movable contact is driven and separated from a fixed contact and simultaneously the plug is electrically in contact with the movable contact.

BACKGROUND OF THE INVENTION

A conventional pin jack with a switch is explained with reference to FIG. 1 and FIG. 2A. Both movable contact 2 and fixed contact 3 are held within a body 1 made of insulation material. The body 1 is composed of a mounting part 4 and a contact housing part 5. The mounting part 4 is formed cylindrically, one end (the front end) of which has an aperture 6 for insertion of a plug pin. The other end of the mounting part 4 is integrally provided with the contact housing part 5. This contact housing part 5 is formed almost as a square box having a rear open surface. The movable contact 2 and the fixed contact 3 are inserted, from the open surface, into the contact housing part 5 and held therein. The mounting part 4 is covered with a metal sleeve 7. The front surface of the sleeve 7 is provided with an aperture 8 which is opposed to the aperture 6 of the mounting part 4 and is a little larger than it. The rear end of the sleeve 7 has an extended portion which is bent almost at a right angle and extended as a ground terminal 9. In FIG. 1, the sleeve 7 is indicated as being removed from the mounting part 4.

The movable contact 2 is composed of a movable piece 19 and a support body 11. The U-shaped support body 11 formed like a plate is inserted into the contact housing part 5 from the aperture at the rear side and both side edges thereof are inserted into grooves (not illustrated) formed in the internal side walls of the contact housing part 5. Thereby, the movable contact 2 is held and fixed. The movable piece 19 is extended toward the mounting part 4 as a spring leaf. The end portion of the movable piece 19 is formed like a tongue and curved toward the support body 11 as a plug receptor 12. The plug receptor 12 faces the rear end of the aperture 6 of the mounting part 4. The intermediate part of the movable piece 19 is integrally provided with protruding contact pieces 13*a*, 13*b* at both sides thereof.

The fixed contact 3 is formed as a U-shaped plate, and it is mounted opposite to the support body 11 of movable contact 2 within the contact housing part 5. The body side edges of the fixed contact 3 are inserted into grooves (not illustrated) formed in the internal side walls of the contact housing part 5. Thereby, said fixed contact is held and fixed to the contact housing part 5. U-shaped arm portions 14*a*, 14*b* of the fixed contact 3 are the fixed contact portions with which the contact pieces 13*a*, 13*b* of the movable contact 2 are in resilient contact. Moreover, the terminals 15, 16 are respectively bent almost at a right angle and extended from different side edges of the support body 11 of the movable contact 2 and the rear end of the fixed contact 3 and these terminals protrud to the outside of the contact housing part 5. The terminals 9, 15 and 16 all extend in the same direction.

As shown in FIG. 2 B, when a contact pin 18 of a plug 17 is inserted from the front side of the mounting part 4, the contact pin 18 engages the plug receptor 12 of the movable contact 2. With further insertion of the contact pin 18, the movable piece 19 of the movable contact 2 is resiliently displaced toward the support body 11. As a result, the contact pieces 13*a*, 13*b* are disengaged from the fixed contact portions 14*a*, 14*b* of the fixed contact 3 and electrical contact between the movable contact 2 and the fixed contact 3 is lost while electrical contact between the movable contact 2 and the contact pin 18 is attained. At the same time, a sleeve 170 of the plug 17 is engaged on the sleeve 7 of the jack.

In the conventional pin jack with a switch, the thickness of the movable contact 2 must be increased to achieve good electrical contact with sufficient contact pressure between the contact pin 18 and the movable contact 2 and to maintain the inserted condition of the plug. However, if it becomes too thick, particularly in case the movable piece 19 is short, the resiliency of the movable piece 19 is lessened, which allows only a small resilient displacement of the movable piece 19. Therefore, the displacement of the contact pieces 13*a*, 13*b* becomes small and the ON-OFF operations between the movable contact 2 and the fixed contact 3 can no longer be reliable. In order to assure the switch operation, the movable piece 19 must be sufficiently long to assure adequate resiliency of the movable contact. Accordingly, the jack becomes large in size. For these reasons, it has been difficult to simultaneously satisfy a good electrical contact function and reliable switch operation of the plug with a movable contact of the cut-and-raised spring type and to assemble a small size plug.

SUMMARY OF THE INVENTION

It is an object of the present invention to provide a jack which assures good contact with a plug and reliable switch operation, and which can be small in size.

The present invention has solved the disadvantages of the prior art type of jack, comprising the aforementioned movable contact and fixed contact, by providing the functions for ensuring good electrical contact with the plug and reliable switch operation to different portions of the movable contact. More particularly, according to the present invention, a receptor which is to be driven by the inserted plug is formed at a free-end portion of the movable contact, and both sides of such a plug receptor are bent toward the fixed contact and are extended opposingly, thereby integrally forming plug holding parts. Moreover, these holding parts are provided with protrusions, and an interval between these protrusions is made smaller than the diameter of a contact pin of the plug to be inserted. The holding parts are also integrally provided with contact parts to be brought in contact with the fixed contact.

The contact pin of the inserted plug is resiliently held between the holding parts with sufficient contact pressure. Thus, the holding part can assure good contact and sufficient force for holding the plug. Since the holding parts are given the function for contact with plug as explained above, the contact portion of the movable contact is placed in excellent contact with the fixed contact, and a thin and flexible contact piece which assures stable contact against vibrations can be obtained.

PREFERRED EMBODIMENT OF THE INVENTION

Figure 1:
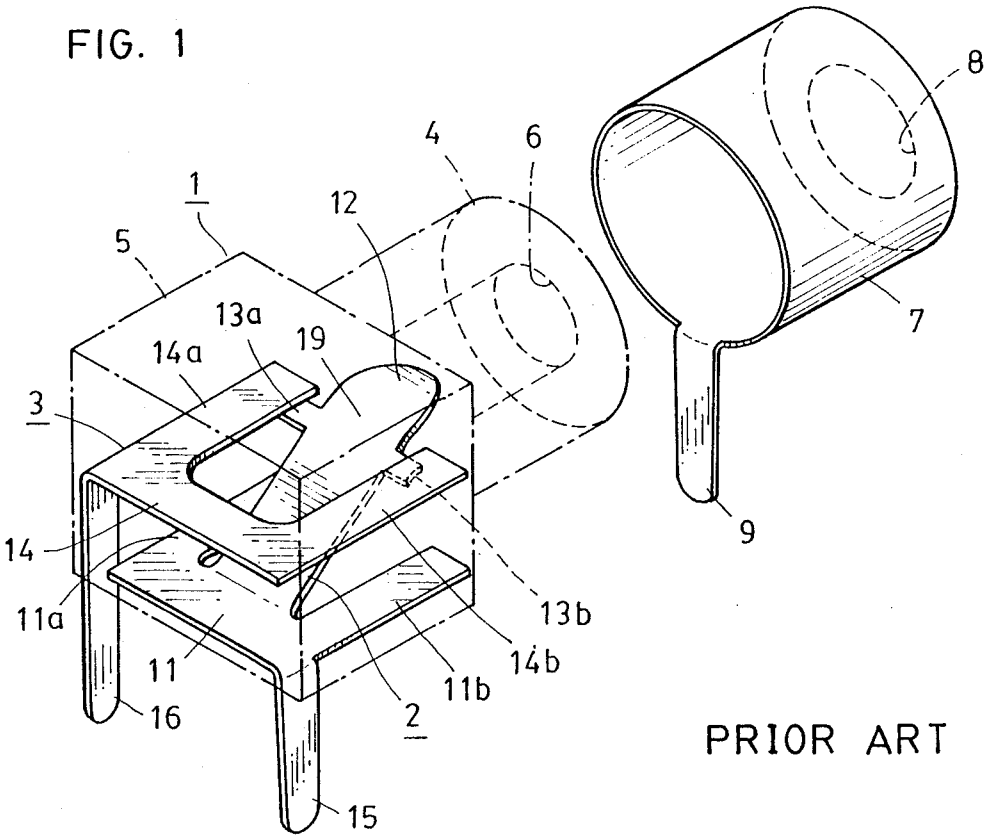
FIG. 1 PRIOR ART
FIG. 1 is a perspective view of a conventional pin jack with switch where jack body 1 is indicated by a broken line and the sleeve 7 is removed.
Figure 2A:
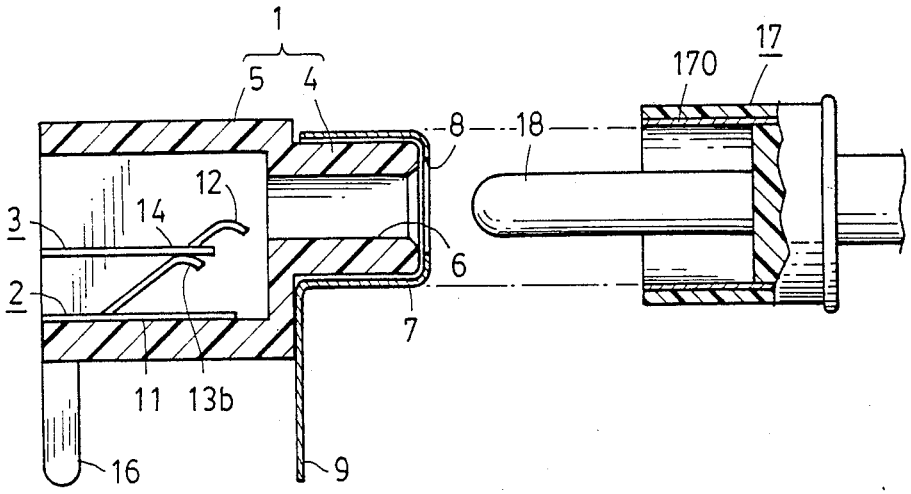
FIG. 2A PRIOR ART
FIG. 2A is a sectional view of the prior art pin jack of FIG. 1 and part of a plug 17.
Figure 2B:
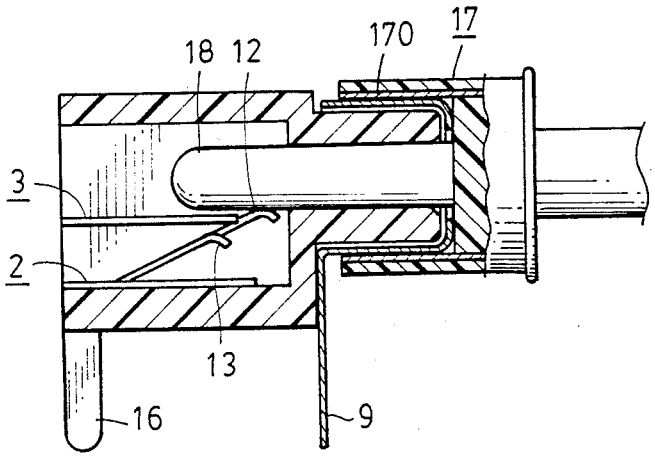
FIG. 2B PRIOR ART
FIG. 2B shows the prior art pin jack of FIG. 2A with the plug inserted thereto.
Figure 3:
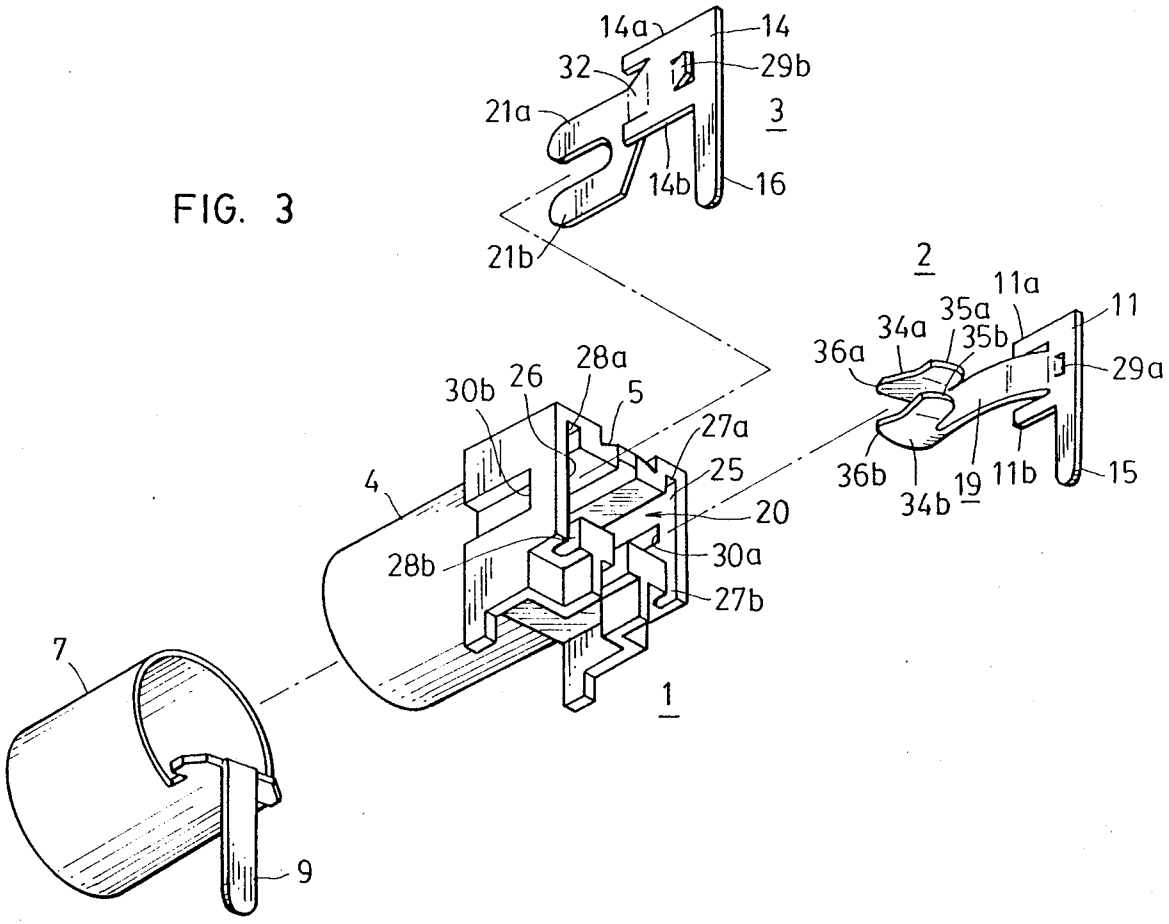
FIG. 3 is a disassembled perspective view indicating an embodiment of jack of the present invention.
Figure 4:
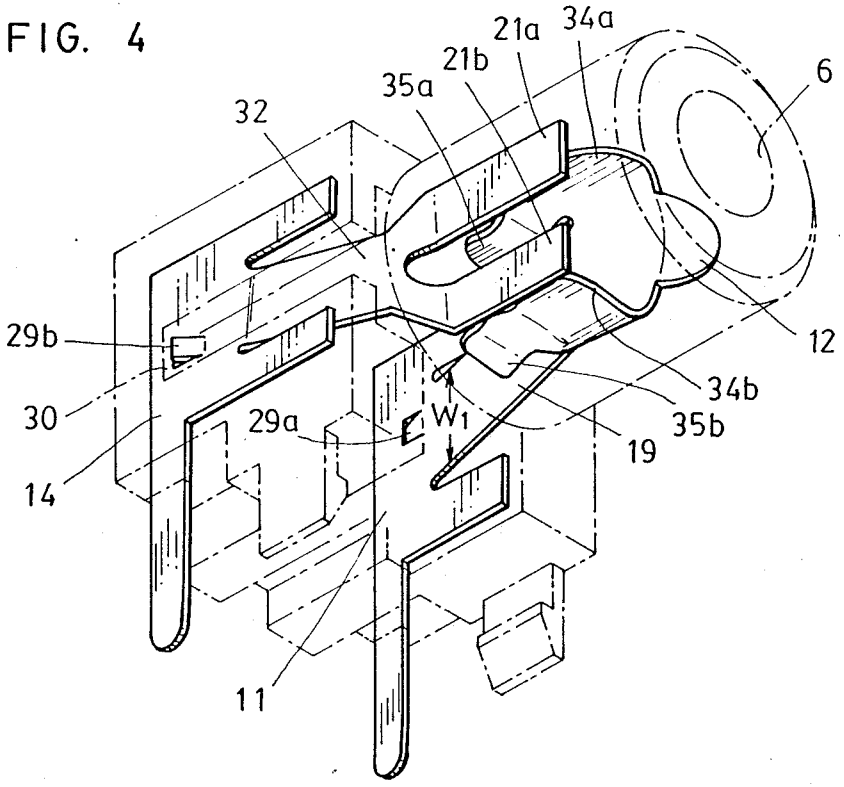
FIG. 4 is an assembled view of the jack shown in FIG. 3 with the jack body shown by a broken line.

FIG. 3 is a disassembled perspective view of an embodiment of the present invention and FIG. 4 is an assembled perspective view of the embodiment. In these figures, the parts corresponding to FIG. 1 and FIG. 2A are given the like numerals. The movable contact 2 is composed of a movable piece 19 and a support body 11 having two arms 11*a*, 11*b*, while the fixed contact 3 is composed of two contact pieces 21*a*, 21*b* and the support body 14 having two arms 14*a*, 14*b*. The support bodies 11, 14 are made in a U-shape. Both pairs of the arms 11*a*, 11*b* and 14*a*, 14*b* are guided respectively into guide grooves 27*a*, 27*b*, 28*a*, 28*b* formed respectively along the opposed side walls 25, 26 within the contact housing part 5. The support bodies 11, 14 are mounted in the contact housing part 5 from the rear open surface 20 of the contact housing part 5. The center coupling parts of the U-shaped support bodies 11, 14 are provided respectively with engaging pieces 29*a*, 29*b* which are obliquely raised toward the side walls 25, 26. These engaging pieces 29*a*, 29*b* engage recesses 30*a*, 30*b* formed in the opposing side walls 25, 26, to prevent the support bodies 11, 14 from being removed.

The movable piece 19 of the movable contact 2 is integrally connected at one end thereof with the coupling portion of the U-shaped support body 11 and is supported obliquely to extend opposite from the engaging piece 29*a* with respect to the plate surface of support body 11. The contact pieces 21*a*, 21*b* of the fixed contact 3 are integrally connected with the coupling portion of the U-shaped support body 14 via a coupling part 32. The other end of the movable piece 19 and the contact pieces 21*a*, 21*b* are extended into an expanded cavity 22 in the mounting part 4 and are placed opposingly in contact each other. The free-end of the movable piece 19 is in contact with the contact pin 18 (FIG. 5) inserted from the aperture 6 of the mounting part 4 and is formed as the plug receptor 12 which is driven by the contact pin 18. This plug receptor 12 is curved so that the insertion force of the contact pin 18 urges the movable piece 19 away from the fixed contact 3. Thereby, the contact pin 18 can be smoothly inserted.

Both side edges of the movable piece 19 behind the plug receptor 12 are protruded like the ears and bent toward the fixed contact to form plug holding parts 34*a*, 34*b*. Flaps 35*a*, 35*b* are formed integrally with the plug holding parts 34*a*, 34*b* to extend rearwardly, i.e. away from the plug receptor 12 and in an approaching relation to each other. An interval between the flaps 35*a*, 35*b* is made narrower than the diameter of contact pin 18 to be inserted. Thus, the plug inserted from the aperture 6 is resiliently nipped and held between the two flaps 35*a* and 35*b*. In this case, it is recommended that the flaps 35*a*, 35*b* be formed thin and long so as to provide sufficient resiliency. It is also desirable that the extending length $l_3$ of the plug holding parts 34*a*, 34*b* is selected to be greater than the radius of the contact pin 18 and the plug holding parts 34*a*, 34*b* are slightly bent toward each other so that a line connecting the holding points on the contact pin surface may be further than the center axis of the contact pin 18 from the movable piece 19, thereby to securely retain the contact pin 18 between the plug holding parts 34*a* and 34*b*. Portions of the plug holding parts 34*a*, 34*b* located in the aperture 6 in this example are slightly protruded toward the fixed contact 3, forming contact parts 36*a*, 36*b* which are resiliently in contact with the fixed contact 3, as shown by a solid line in FIG. 5, when the plug is not inserted.

The two contact pieces 21*a*, 21*b* of the fixed contact 3 are formed in a U-shape and arranged to be disposed opposite to the plug holding parts 34*a*, 34*b* of the movable piece 19 in the mounting part 4. The contact parts 36*a*, 36*b* of the plug holding parts 34*a*, 34*b* are resiliently pressed against the plate surfaces of the contact pieces 21*a*, 21*b*, realizing good electrical contact.

The terminals 15, 16 are formed integrally with the support bodies at one rear corner thereof (the lower corner in the figure) to extend outside of the contact housing part 5 at a right angle to the plug inserting and removing direction.

Figure 5:
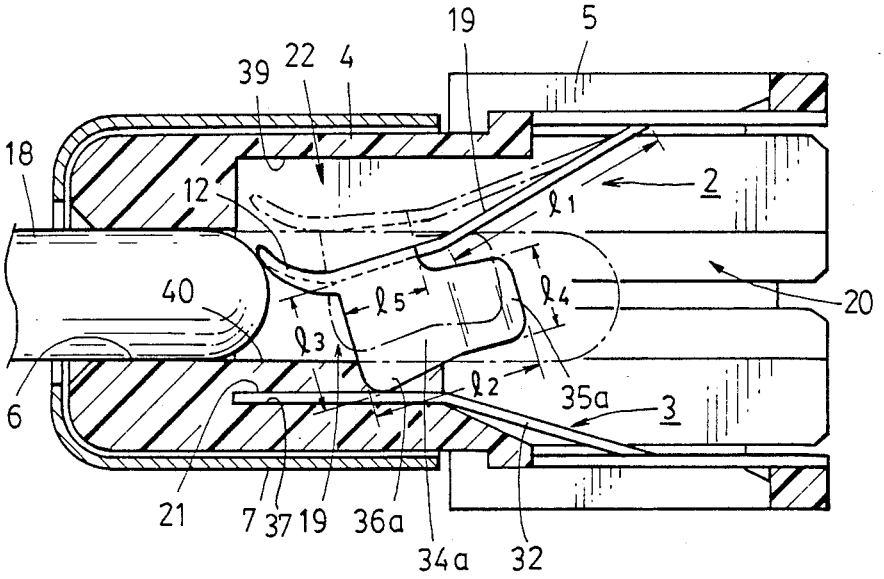
FIG. 5 is a sectional view indicating switch operation due to insertion of a plug pin 18 into the jack shown in FIG. 4.
Figure 6:
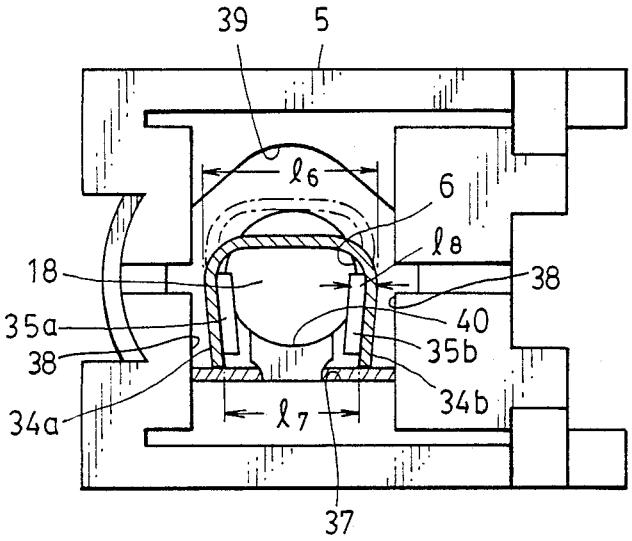
FIG. 6 is a right side elevation of FIG. 6.

FIG. 5 and FIG. 6 show the opening and closing operations of the switch of the jack through the insertion and removal of plug.

The two contact pieces 21*a*, 21*b* of the fixed contact 3 are placed on a floor 37 in the expanded cavity 22. In this embodiment, a guide ridge 40 is formed integrally with the floor 37 to extend between these contact pieces 21*a* and 21*b* in a direction of the insertion of the contact pin 18 in flush relation with the inner surface of the aperture 6. This guide ridge 40 has grooves at its foot portion on both sides thereof which extend along the guide ridge 40 so that the contact pieces 21*a*, 21*b* fitted into the grooves are fixedly held between the ridge 40 and side walls 38 of the expanded cavity 22.

The contact pin 18 inserted from the aperture 6 proceeds into the expanded cavity 22 along this guide ridge 40 and is then brought into contact with the plug receptor 12 of the movable contact 2. As indicated by a broken line, the contact pin 18 pushes in a lateral direction the plug receptor 12 to drive the movable piece 19 away from the fixed contact 3. Therefore, the contact parts 36*a*, 36*b* are disengaged from the contact pieces 21*a*, 21*b* of the fixed contact 3, disconnecting the electrical connection between the movable contact 2 and the fixed contact 3.

The contact pin 18 proceeds into the space between the plug holding parts 34*a*, 34*b* and reaches the flaps 35*a*, 35*b* of the holding parts 34*a*, 34*b*, while pushing them apart from each other. The contact pin 18 is held resiliently and reliably by these flaps 35*a*, 35*b*.

In such plug inserting process, the plug is guided by the guide ridge 40. The inserted contact pin 18 will never be in contact with any of the contact pieces 21*a*, 21*b* due to the existence of guide ridge 40 even when a force is applied to the external side of the plug 17 perpendicularly to the axial direction. Therefore, the plug 17 will never be short-circuitted to the fixed contact 3.

The free-end part of the movable contact 2 is displaced by insertion of the plug 17. A high ceiling part 39 is formed in the expanded cavity 22 so as to provide a clearance for sufficient displacement of the movable contact 2.

According to the jack of the present invention, the plug holding function and switch function are performed at different portions of the movable contact 2. Therefore, the plug holding mechanism can be formed considering only the plug holding function, while the switch mechanism is formed considering only the swithc function. In short, the functions can be designed independently. For example, the plug holding parts 34*a*, 34*b*, can be formed as parts of the movable contact 2 by pressing a thin plate. Since the contact pin 18 is held by the relatively short flaps 35*a*, 35*b*, the contact pin 18 receives a relatively strong clamping force by the flaps 35*a*, 35*b*, realizing good electrical contact between them and secure holding of the plug, in spite of the thin flaps. Also, even when the movable piece 19 is made short, the thin movable piece 19 allows relatively large displacement of the contact parts 36*a*, 36*b*. Thus, large opening and closing operations of the switch can be ensured, the contact parts 36*a*, 36*b* can be placed in contact with the contact pieces 21*a*, 21*b* of the fixed contact 3 with a sufficient contact pressure, and a switch having contacts which are flexible and resistive to vibration can be formed in the jack. Moreover, since the switch is provided within the mounting part 4, the size of the front and rear sides can be reduced as compared with the conventional pin jack with switch and thereby the total size can also be reduced.

The present invention can also be adapted not only to the pin jack with switch but also to an ordinary jack.

For example, good results can be obtained, using a jack wherein the length of body 1 is 18 mm, the external diameter of mounting part 4 is 7.5 mm, the external size of contact housing part 5 is $10\times10$ mm$^2$, length $l_1$of movable piece 19 up to the plug holding parts 34*a*, 34*b* is 5.8 mm, width $W_1$ of the movable piece 19 is 3 mm (FIG. 4), length $l_2$ in the front and rear direction of holding parts 34*a*, 34*b* including the flaps 35*a*, 35*b* is 4.5 mm, the lateral lengths $l_3$ and $l_4$ at the front and rear of the holding parts 34*a*, 34*b* are 2.9 mm and 2.2 mm, length $l_5$ of bent portions of the holding parts 34*a*, 34*b* is 2 mm, intervals $l_6$, $l_7$ (FIG. 6) of the holding parts 34*a*, 34*b* at the bent portions and at the free ends thereof are respectively 3.6 mm, 3.2 mm, the inwardly bent length $l_8$ of the flaps 35*a*, 35*b* is 0.55 mm, and the diameter of the contact pin 18 is 3 mm.

What is claimed is:

1. A jack with a switch comprising:

a jack body made of an insulating material and having a contact housing cavity formed therein, said jack body having an insertion hole formed in a front end face of said jack body in communication with said contact housing cavity, for receiving a contact pin of a plug;

a guide ridge formed integrally with an inner wall of said jack body to extend in the direction of plug insertion in flush relation with an inner surface of said insertion hole;

a fixed electrical contact mounted in said contact housing cavity on an inner wall surface thereof, said fixed contact being so disposed in said cavity that at least a portion of said fixed contact will oppose a peripheral portion of said plug contact pin in spaced relation to said contact pin when said contact pin is inserted into said insertion hole;

a movable electrical contact disposed in said contact housing cavity in opposing relation to said fixed contact, said movable contact comprising a support portion fixedly mounted in said contact housing cavity and a movable plate portion which extends from said support portion toward said insertion hole and is resiliently movable inside said contact housing cavity;

a pair of holding parts formed at a free end of said movable plate portion integrally therewith, said pair of holding parts extending toward said fixed contact in a U-shape configuration and defining contact portions which are normally held in contact with said fixed contact by a resilient force of said movable plate portion when said contact pin is not inserted into said insertion hole, said pair of holding parts also defining a pair of flaps which extend toward said support portion for resiliently holding therebetween said contact pin when said contact pin is inserted into said insertion hole; and a pin receptor formed integrally with said movable plate portion to extend obliquely across the axis of said insertion hole from the free end of said movable plate portion in a direction away from said holding parts so that as said contact pin is inserted into said insertion hole, an end portion of said contact pin slidably pushes against said pin receptor to laterally displace said movable plate portion against the resilient force thereof away from said fixed contact to disengage said contact portions of said holding parts from said fixed contact and to hold said contact pin between said pair of flaps.

2. A jack according to claim 1 wherein said pair of flaps have free ends which approach one another.

3. A jack according to claim 1 wherein the arm portions of said U-shape holding parts are longer than the radius of said contact pin and extend inwardly toward one another.

4. A jack according to claim 1 wherein said contact portions of said pair of holding parts are defined at corners of said holding parts opposite from said flaps.

5. A jack according to claim 1 wherein said jack body comprises a cylindrical mounting part which defines said insertion hole and a rectangular housing part formed integrally with said cylindrical mounting part, a rear portion of said insertion hole being expanded to define a front cavity inside said mounting part which opens into a rear cavity formed in said rectangular housing part, said front and rear cavities together constituting said contact housing cavity, said fixed contact comprising a support body and contact piece means, and said movable contact and said fixed contact being so mounted in said contact housing cavity that the support bodies of both said movable contact and said fixed contact are fixedly disposed in said rear cavity and said holding parts of said movable contact and said contact piece means of said fixed contact each extend into said front cavity.

6. A jack according to claim 5 wherein sid cylindrical mounting part is covered by a metal sleeve.

7. A jack according to claim 5 wherein said guide ridge extends along said front cavity, said contact piece means of said fixed contact comprising a pair of contact pieces which extend from said support body of said fixed contact on both sides of said guide ridge opposite to said contact portions of said holding parts.

8. A jack according to claim 7 wherein grooves are formed along both sides of said guide ridge, portions of said contact pieces being inserted into said grooves.

* * * * *